US005777534A

United States Patent [19]

Harrison

[11] Patent Number: 5,777,534

[45] Date of Patent: Jul. 7, 1998

[54] INDUCTOR RING FOR PROVIDING TUNING AND COUPLING IN A MICROWAVE DIELECTRIC RESONATOR FILTER

[75] Inventor: William H. Harrison, Payson, Ariz.

[73] Assignee: L-3 Communications Narda Microwave West, Rancho Cordova, Calif.

[21] Appl. No.: 757,147

[22] Filed: Nov. 27, 1996

[51] Int. Cl.[6] ..... H01P 1/20; H01P 7/10

[52] U.S. Cl. ..... 333/202; 333/219.1; 333/230; 333/235

[58] Field of Search ..... 333/202, 208, 333/209, 212, 219.1, 223, 224, 227–233, 235; 331/96, 107 DP

[56] References Cited

U.S. PATENT DOCUMENTS

| | | | |
|---|---|---|---|
| 2,607,017 | 8/1952 | Bruck | 315/5 |
| 2,698,923 | 1/1955 | Edson | 333/228 |
| 2,954,536 | 9/1960 | Muller | 333/73 |
| 3,737,816 | 6/1973 | Honicke | 333/209 |
| 3,899,759 | 8/1975 | Hines et al. | 333/212 |
| 4,138,652 | 2/1979 | Nishikawa et al. | 333/202 |
| 4,167,713 | 9/1979 | Pfitzenmaier | 333/212 |
| 4,216,448 | 8/1980 | Kasuga et al. | 333/203 |
| 4,246,555 | 1/1981 | Williams | 333/209 |
| 4,275,369 | 6/1981 | Sekiguchi | 333/209 |
| 4,291,288 | 9/1981 | Young et al. | 333/212 |
| 4,453,146 | 6/1984 | Fiedziuszko | 333/212 |
| 4,477,785 | 10/1984 | Atia | 333/202 |
| 4,575,699 | 3/1986 | Lockwood | 333/219 |
| 4,673,895 | 6/1987 | Tadachi et al. | 331/99 |
| 4,686,496 | 8/1987 | Syrett et al. | 333/202 |
| 4,725,797 | 2/1988 | Thompson et al. | 333/212 |
| 4,734,647 | 3/1988 | Yoshimura | 324/318 |
| 4,746,883 | 5/1988 | Sauvage et al. | 333/202 |
| 4,757,289 | 7/1988 | Kosugi et al. | 333/209 |
| 4,761,625 | 8/1988 | Sharma | 333/209 |
| 4,862,122 | 8/1989 | Blair, Jr. et al. | 333/202 |
| 4,890,079 | 12/1989 | Sasaki | 333/206 |
| 5,083,102 | 1/1992 | Zaki | 333/212 |
| 5,220,300 | 6/1993 | Snyder | 333/210 |
| 5,239,280 | 8/1993 | Noguchi et al. | 333/206 |
| 5,268,659 | 12/1993 | Zaki et al. | 333/209 |
| 5,373,270 | 12/1994 | Blair et al. | 333/202 |
| 5,410,284 | 4/1995 | Jachowski | 333/202 |
| 5,604,471 | 2/1997 | Rattila et al. | 333/202 |
| 5,608,363 | 3/1997 | Cameron et al. | 333/202 |

FOREIGN PATENT DOCUMENTS

| | | | |
|---|---|---|---|
| 0 101 369 | 2/1984 | European Pat. Off. . | |
| 0112301 | 6/1985 | Japan | 331/96 |
| 63-302601 A | 12/1988 | Japan . | |
| 1-260901 A | 10/1989 | Japan . | |

OTHER PUBLICATIONS

"Dielectric Resonators", D. Kajfez et al., Artech House Inc., Library of Congree 86–70447, pp. 1–8.

Radio Engineers Handbook, F.E. Terman, Stanford University (McGraw–Hill), pp. 162–164, no date.

*Primary Examiner*—Seungsook Ham

*Attorney, Agent, or Firm*—Perman & Green, LLP

[57] ABSTRACT

An inductive tuning disk for tuning a resonant frequency of a resonator of a microwave filter. The microwave filter includes a housing that encloses a cavity and a resonator therein. The resonator exhibits a magnetic field that appears in the cavity. The inductive tuning disk includes a dielectric base which is supported from a top wall of the housing by a support, and which is disposed within the cavity at an adjustable height above the resonator. The inductive tuning disk further includes an inductor ring which is disposed over a portion of a top surface of the dielectric base, and which is spaced apart from a center of the base. The inductor ring includes an electrically conductive material. The inductor ring interacts with the magnetic field to cause a resonant frequency of the resonator to vary as a function of the adjustable height. The disk may also be used to couple the magnetic energy between a pair of resonators of a filter.

33 Claims, 5 Drawing Sheets

INDUCTOR RING FOR PROVIDING TUNING AND COUPLING IN A MICROWAVE DIELECTRIC RESONATOR FILTER

FIELD OF THE INVENTION

This invention relates to microwave dielectric resonator (DR) filters and, in particular, this invention relates to an inductor ring for providing tuning and coupling in a DR microwave filter.

BACKGROUND OF THE INVENTION

It is known in the art that dielectric resonators exhibit superior performance characteristics over those exhibited by most other known types of resonators. By example, dielectric resonators exhibit higher unloaded Q values and lower insertion loss than combline and cavity-type filters, which include metallic resonators.

Owing to the superior performance characteristics of dielectric resonators, the use of dielectric resonators has become widespread, particularly in highly selective bandpass filters. By example, dielectric resonators have been used in cellular telephone applications, wherein it is necessary to provide great filter selectivity in order to prevent interference between (Federal Communications Commission defined) channels having closely spaced frequencies.

Unlike metallic resonators, dielectric resonators yield little external high impedance electric fields when they are operated in desired operating modes. That is, the electric field of a dielectric resonator is contained substantially within the resonator structure in the desired mode of operation. The magnetic fields yielded by dielectric resonators, on the other hand, do extend beyond the confines of the resonator structures and into, by example, a cavity of a filter in which the resonators are contained. These magnetic fields can be used to provide proximity magnetic coupling between a pair of adjacent dielectric resonators. Also, by employing an electrically conductive device to interact with these magnetic fields, the dielectric resonators can be tuned to exhibit a desired resonant frequency.

An exemplary conventional device for tuning a dielectric resonator 34 of a bandpass filter 4 is illustrated in FIGS. 4*a* and 4*b*. The device includes a metallic disk 36 that is attached at a top surface thereof to one end of a screw 40. The filter comprises the disk 36, a nut 38, the screw 40, a housing 30, a cavity 32, and the dielectric resonator 34. The disk 36 is supported in the cavity 32 by the screw 40, which protrudes through a top wall of the housing 30. The screw is held in place by the nut 38. The dielectric resonator 34 is mounted on a support 34*a*.

The distance between a top surface of the resonator 34 and a bottom surface of the disk 36 may be varied by rotating the screw in a clockwise or counter-clockwise direction. The disk 36 interacts with the magnetic field (not shown) of the resonator 34, and causes the equivalent inductance and the resonant frequency of the resonator 34 to vary as a function of the distance between the bottom surface of the disk 36 and the top surface of the resonator 34.

Unfortunately, the disk 36 has a disadvantage that it can cause the filter 4 to yield undesired spurious responses in the filter's stopband at frequencies that are very close to the upper edge of the filter's passband. These undesired spurious responses occur as a result of the disk 36 and the screw 40 being electrically coupled to one another, and the screw 40 being grounded to the housing 30. With this configuration, the disk 36 and the screw 40 behave like a capacitor and an inductor, respectively, of a resonant circuit. Thus, when the screw 40 is adjusted to tune the filter's passband, it can cause these components to have a resonant frequency that is near the passband frequency of filter 4, and a degradation of the filter's upper stopband can occur.

In view of the disadvantages offered by the prior art device described above, it can be appreciated that it would be desirable to provide a tuning device which overcomes these disadvantages.

OBJECTS OF THE INVENTION

It is an object of this invention to provide an improved means for tuning dielectric resonators of a dielectric resonator filter.

It is another object of this invention to provide an improved means for adjusting magnetic coupling between a pair of dielectric resonators of a dielectric resonator filter.

Further objects and advantages of this invention will become apparent from a consideration of the drawings and ensuing description.

SUMMARY OF THE INVENTION

The foregoing and other problems are overcome and the objects of the invention are realized by an inductor ring for providing tuning and coupling in a microwave filter.

In accordance with one embodiment of the invention, the inductor ring is used to provide tuning for dielectric resonators of a microwave filter. The microwave filter includes a housing that encloses a cavity and dielectric resonators therein. Each dielectric resonator exhibits a magnetic field that appears in the cavity. The inductor ring is supported by a dielectric base. The base is supported from a top wall of the housing by a supporting means that includes a screw. The screw is in threaded engagement with the top wall of the housing, and has an end portion that is attached to a center portion of the dielectric base. The assembly of the dielectric base and the inductor ring form an inductive tuning disk. The disk is disposed within the cavity at a height above a dielectric resonator, which height is variable by adjustment of the screw. The inductor ring interacts with the magnetic field of the dielectric resonator to cause a resonant frequency of the resonator to vary as a function of the adjustable height.

In accordance with another embodiment of the invention, the inductor ring is used to adjust a coupling between a pair of dielectric resonators of a microwave filter. The principle coupling is provided by proximity of the resonators to each other. In this embodiment of the invention, an inductive coupling disk is provided for adjusting this coupling between the pair of resonators of the microwave filter. The microwave filter includes a housing that encloses a cavity and the resonators therein. Each of the resonators exhibits a magnetic field that appears in the cavity. The inductive coupling disk is constructed of a base and the inductor ring, and is constructed similar to the inductive tuning disk described above. The inductive coupling disk is supported from the top wall of the housing by a screw, and is disposed within the cavity between the pair of resonators at a height that may be varied by adjustment of the screw. The inductor ring of the inductive coupling disk adds to proximity mutual coupling occurring between the resonators. The additional level of coupling provided by the inductor ring is a function of the adjustable height of the inductive coupling disk. The inductive coupling disk provides a convenient means for adjusting the filter bandwidth.

For either of the embodiments described above, the inductor ring comprises a wire, film or strip of metal comprised preferably of copper. The inductor ring preferably has a circumference that is less than one wavelength. Also for either of the embodiments described above, a post may be used in lieu of the screw.

In accordance with another aspect of the invention, a filter is provided. The filter comprises a housing which encloses a cavity therein. The filter also comprises a resonator that is secured to a bottom wall of the housing. The resonator exhibits a magnetic field that appears within the cavity. Also included within the filter is the inductive tuning disk. The inductive tuning disk is supported to a top wall of the housing by a screw, and is located within the cavity at a height which is determined by adjustment of the screw. The inductor ring tunes the resonator to vary the resonator's resonant frequency as a function of the height of the inductor ring, as was described above.

In accordance with another aspect of the invention, another filter is provided. This filter also comprises a housing that encloses a cavity therein. A pair of resonators are secured to a bottom wall of the housing, and are sufficiently spaced apart to enable magnetic coupling to occur between them. Each resonator exhibits a magnetic field within the cavity. The filter also comprises an inductive coupling disk which is supported to a top wall of the housing by a screw. The disk is spaced apart from the resonators and has a center axis that is located between the resonators. The inductive coupling disk is disposed within the cavity at a height above the bottom wall of the housing. This height is determined by adjustment of the screw. The inductor ring of the disk interacts with the magnetic fields of the resonators and couples the resonators in the manner described above. In another embodiment of the invention, the screw supports the inductive coupling disk to the bottom wall of the housing.

BRIEF DESCRIPTION OF THE DRAWINGS

The above set forth and other features of the invention are made more apparent in the ensuing description when read in conjunction with the accompanying drawings, wherein.

DETAILED DESCRIPTION OF THE INVENTION

Figure 1A:
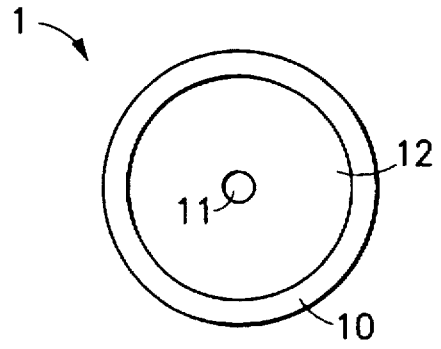
FIG. 1*a* is a top view of an inductive tuning and coupling disk that is constructed in accordance with the invention.
Figure 1B:
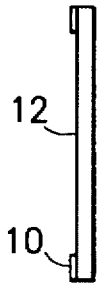
FIG. 1*b* is a side view of the inductive tuning and coupling disk of FIG. 1*a;*

FIGS. 1*a* and 1*b* illustrate an inductive tuning and coupling disk 1 that is constructed in accordance with the invention. In a preferred embodiment of the invention, the disk 1 comprises an inductor ring 10 that is mounted on a top surface of a base 12. The inductor ring 10 may be formed as a wire, strip or film comprised of an electrically-conductive material. In a preferred embodiment of the invention, the inductor ring 10 comprises copper. The inductor ring 10 and the base 12 are preferably circular and have a mean circumference that is less than one wavelength so that, when these components are being employed in a microwave filter, they do not resonate at the filter's resonant frequency. In accordance with one embodiment of the invention, the inductor ring 10 is constructed on the base 12 using a photo etching technique.

The base 12 may comprise any suitable dielectric insulating material. In the preferred embodiment of the invention, the base 12 is constructed as a disk-shaped, etched circuit board. A top surface of the base 12 includes a circular recess or hole 11 that is located at a center of the base 12. The recess 11 may include threads for engaging with threads a screw, or a rivet may be used to secure an end of the screw within the recess 11.

Figure 5A:
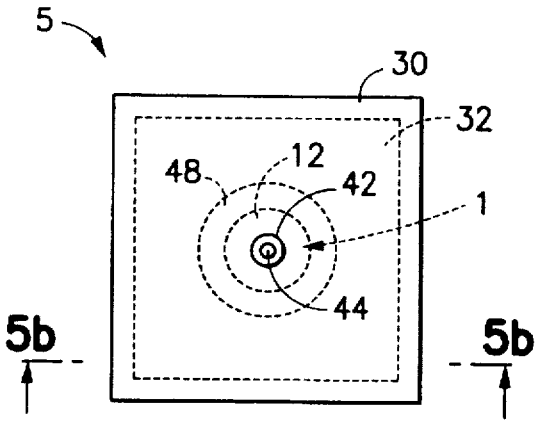
FIG. 5*a* is a top view of a filter that includes an inductive tuning disk constructed in accordance with the invention, and which provides tuning for a dielectric resonator.
Figure 5B:
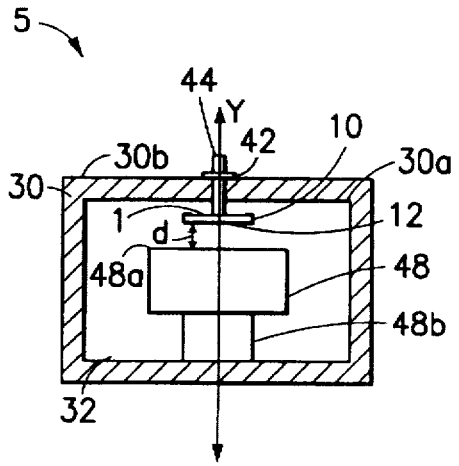
FIG. 5*b* is a cross section of the filter of FIG. 5*a*, taken along the line 5*b*—5*b* of FIG. 5*a;*

In accordance with one embodiment of the invention, the disk 1 is used to provide tuning for a resonator of a filter. This embodiment of the invention may be understood in view of FIGS. 5*a* and 5*b*, which illustrate the disk 1 positioned within a cavity 32 that is enclosed within a housing 30 of a portion of a filter 5. Also illustrated in FIGS. 5*a* and 5*b* is a dielectric resonator 48 which is located within the cavity 32, and which is mounted on a dielectric support 48*b* secured to a bottom wall of the housing 30. As can be appreciated by those having skill in the art, the specific dimensions of the housing 30, the cavity 32, the resonator 48, and the support 48*b*, and the materials that form the housing 30, the resonator 48, and the support 48*b*, may be selected in accordance with filter performance requirements for a particular application of interest. The technique used for determining these dimensions and materials may be any suitable procedure known in the art such as that disclosed in the following publications: (1) "Dielectric Resonators", by Darko Kajfez and Pierre Guillon (Artech House Inc., Library of Congress 86-70447); (2) "Microwave Filters, Impedance-Matching Networks, and Coupling Structures", by Matthaei, Young, and Jones (McGraw Hill 64-7937); (3) "Very High Frequency Techniques", Vol. 2, Radio Research Laboratory, Harvard University (McGraw-Hill); and (4) "Radio Engineers Handbook", by F. E. Terman, Stanford University (McGraw-Hill).

Figure 7:
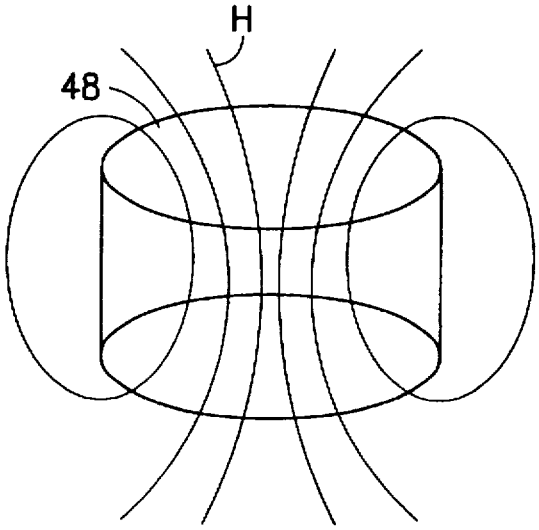
FIG. 7 is a stylized view of dielectric resonator that is constructed in accordance with the invention, and shows a magnetic field of the dielectric resonator.

The resonator 48 preferably operates in a $TE_{01\delta}$ mode, which is described in the Kajfez and Guillon publication. Dielectric resonators which operate in this mode yield magnetic fields that have a similar shape as the magnetic field (H) shown to be emanating from dielectric resonator 48 in FIG. 7. In cases in which the resonator 48 is placed within a housing, the housing perturbs the magnetic field so as to raise the resonator's resonant frequency. However, the shape of the magnetic field (H) remains the same, as is known in the art. In a similar manner, the magnetic field (H) of the resonator 48 shown in FIGS. 5*a* and 5*b* is affected by the presence of the inductor ring 10 of the inductive tuning disk 1. By adjusting the location of the inductor ring 10 within the cavity 32, the resonator 48 may be tuned to exhibit a desired resonant frequency, as will be further described below.

FIGS. 5*a* and 5*b* also illustrate a screw 44. The screw 44 may comprise any suitable rigid material. Since the screw 44 is electrically insulated from the ring 10, the screw 44 may be constructed of either dielectric material or an electrically-conductive metal. An end of the screw 44 is secured within recess 11 to attach the screw 44 to the base 12. The end of the screw 44 may be secured within recess 11 by any suitable means, including by a threaded engagement or by a rivet, as was described above. Also, a post may be used in lieu of the screw 44.

Preferably, the screw 44 has a length which is short enough to cause the screw's resonant frequency to be much higher than the passband frequencies of the filter 5. However, DR filters typically exhibit spurious responses at much lower frequencies than those of spurious responses exhibited by combline filters. These spurious responses are unavoidable and can occur due to, for example, higher order resonances present in the dielectric materials forming the filters' resonators. Also, DR filter cavities are often large and, as a result, waveguide modes can propagate through the filters. These waveguide modes can cause these filters to yield other spurious responses. The dimensions of the inductor ring 10, and the length of the portion of the screw 44 that extends into the filter cavity 32 are preferably such that these components do not resonate at lower frequencies than those at which spurious responses can occur due to the presence of other modes of the dielectric resonator 48 and any waveguide modes in the filter.

The screw 44 protrudes through, and is in threaded engagement with a hole (not shown) that is provided in a top wall 30*b* of the housing 30. Preferably, the location of the hole in the top wall 30*b* is such that, while the screw 44 is disposed in the hole, the screw 44 and the disk 1 attached to the screw 44 have a common center axis y which passes through a geometric center of the resonator 48. Also, the inductor ring 10 is preferably positioned on the disk 1 so as to be concentric with these components. The screw 44 is secured in position by a nut 42.

The disk 1 is positioned at a variable height within the cavity 32. More particularly, the disk 1 is positioned within the cavity 32 in such a manner that a bottom surface of the inductor ring 10 is separated from the top surface 48*a* of the resonator 48 by a distance (d). This distance (d) can be varied by adjusting the screw 44.

The inductor ring 10 behaves like a shortened turn of a transformer winding within an equivalent circuit of the ring 10 and the resonator 48. The inductor ring 10 causes the resonant frequency of the resonator 48 to vary as a function of the distance (d), owing to a current that is induced into the inductor ring 10 by the resonator 48 and reflected back to the resonator 48 from the inductor ring 10. This current has an amplitude that is a function of the distance (d). By adjusting the screw 44 so that the distance (d) between the bottom surface of the inductor ring 10 and the top surface 48*a* of the resonator 48 becomes shorter, the resonant frequency of the resonator 48 is caused to increase. By adjusting the screw 44 so that the distance (d) becomes greater, the resonant frequency of the resonator 48 is caused to decrease. The inductor ring 10 interacts with the magnetic field of the resonator 48 in a manner that is known in the art. The tuning of resonators by positioning electrically conductive materials at various heights above the resonators is described in, for example, the Kajfez and Guillon publication referred to above.

Being that the base 12 comprises a dielectric material, the screw 44 and the inductor ring 10 are not electrically coupled to one another (i.e., these components are insulated from one another). As such, the inductive tuning disk 1 offers a number of advantages over prior art devices that include, by example, metal disks for tuning resonators of a filter. One advantage is that, unlike metal disk devices, the inductor ring 10 presents a negligible amount of capacitance at the end of the tuning screw 44 secured to the base 12. Thus, the presence of the ring 10 and the screw 44 does not present equivalent capacitive loading of the tuning device in filter 5. As a result, if spurious responses occur at all, they occur at much higher frequencies than the passband frequencies of the filter 5. Thus, there is a minimum degradation of the upper stopbands of the filter 5.

Figure 2A:
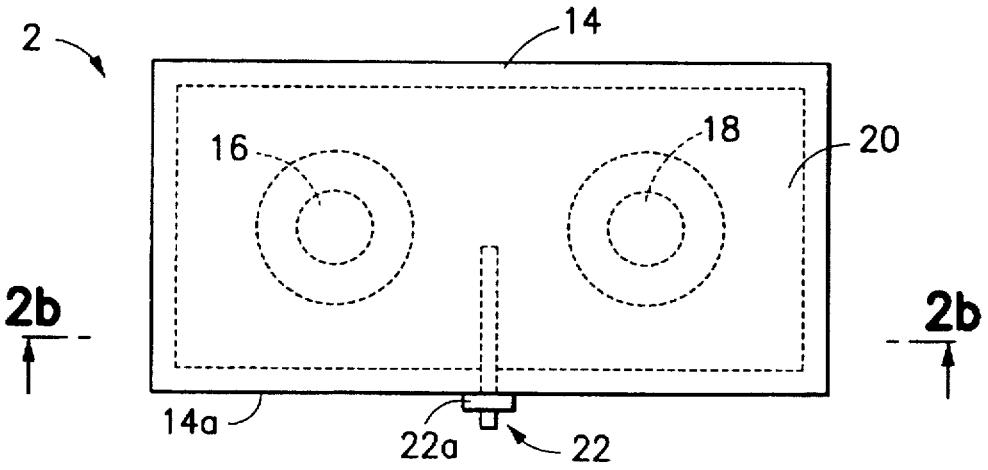
FIG. 2a PRIOR ART
FIG. 2*a* is a top view of a cross section of a prior art device for providing magnetic coupling adjustment between a pair of dielectric resonators of a filter.
Figure 2B:
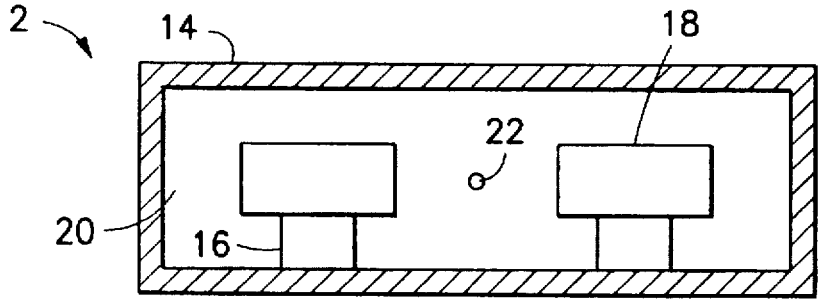
FIG. 2b PRIOR ART
FIG. 2*b* is a cross-sectional view of the device of FIG. 2*a*, taken along the line 2*b*—2*b* of FIG. 2*a;*

Before describing another embodiment of the invention, a brief reference will be made to FIGS. 2*a* and 2*b*, which illustrate a coupling screw 22 for coupling a pair of dielectric resonators 16 and 18 of a filter 2. The screw 22 protrudes through a wall 14*a* of a housing 14 of the filter 2 and into a cavity 20. The screw 22 extends along an axis that is normal to a plane in which magnetic fields (not shown) of the respective resonators 16 and 18 appear.

The resonators 16 and 18 are spaced sufficiently apart to permit a level of inductive coupling to be provided between the resonators 16 and 18 which is less than that required for the filter 2 to yield a desired passband bandwidth. The screw 22 is used to provide additional magnetic coupling between the resonators 16 and 18 for enabling filter 2 to yield the desired passband bandwidth.

As may be appreciated by those having skill in the art, the level of magnetic coupling provided between the resonators 16 and 18 by the screw 22 may be varied by adjusting the distance by which the screw extends into the cavity 20. As this distance is increased towards one-quarter wavelength, for example, the level of coupling provided by the screw 22 increases.

As the distance by which the screw 22 extends into the cavity 20 approaches one-quarter wavelength, the screw 22 can cause the filter to exhibit a spurious response at a frequency that is near, and above, the passband frequencies of the filter. Also, in cases wherein multiple coupling screws are employed in a DR filter, the coupling screws can alter the filter's upper stopband. Thus, although the use of coupling screws for coupling resonators of a DR filter may be beneficial in some applications, it may not be suitable in other applications. In view of these considerations, it can be appreciated that it would be desirable to provide another type of coupling device which does not exhibit these response characteristics.

Figure 3A:
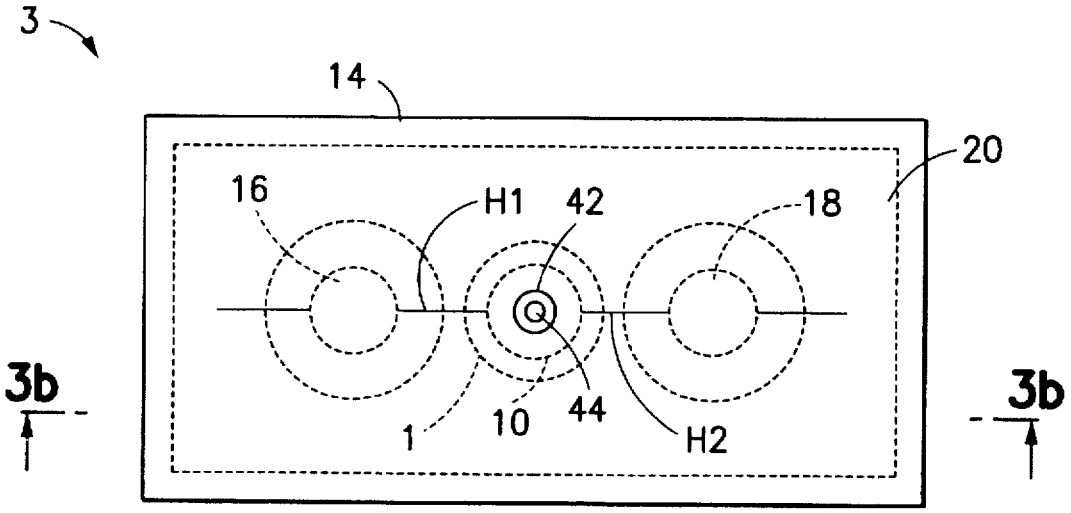
FIG. 3*a* is a top view of a filter that includes an inductive coupling disk that is constructed in accordance with the invention, and which provides an adjustment to magnetic coupling between a pair of dielectric resonators.
Figure 3B:
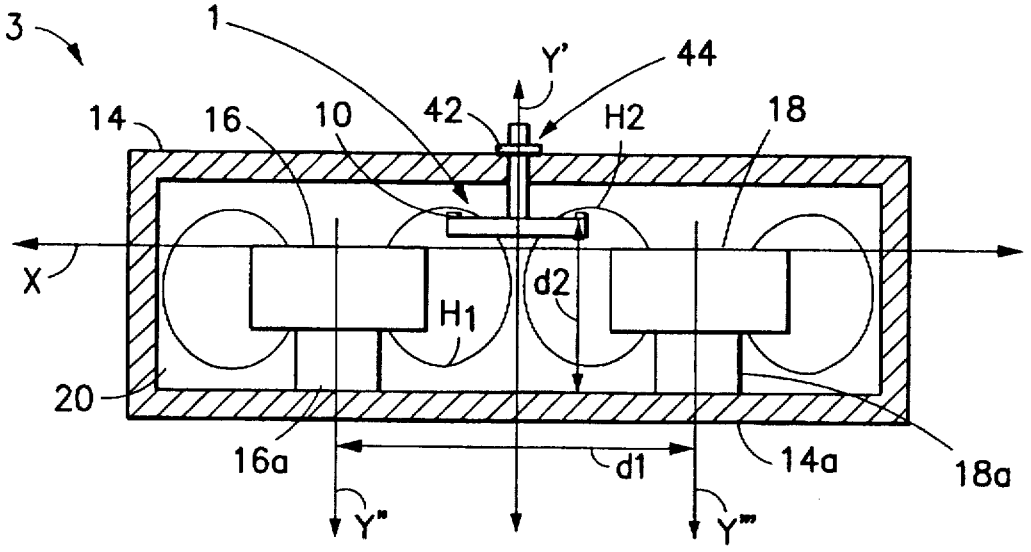
FIG. 3*b* is a cross section of the filter of FIG. 3*a*, taken along the line 3*b*—3*b* of FIG. 3*a;*

Therefore, in accordance with another embodiment of the invention, the disk 1 is used to adjust coupling between resonators of a filter. The advantages of using the disk 1 to adjust coupling between resonators of a filter will be described below. In this embodiment of the invention, the principle coupling occurs by proximity of the resonators, and the disk 1 serves to adjust (i.e., increase) this coupling. This embodiment of the invention may be understood in view of FIGS. 3*a* and 3*b*, which illustrate the inductive coupling disk 1 positioned within a cavity 20 enclosed within a housing 14 of filter 3. Also illustrated in FIGS. 3*a* and 3*b* are a pair of dielectric resonators 16 and 18 that are mounted on respective dielectric supports 16*a* and 18*a* secured to a bottom wall of the housing 14. As can be appreciated by those having skill in the art, the specific dimensions of the housing 14, the cavity 20, the resonators 16 and 18, the dielectric supports 16*a* and 18*a*, as well as the spacing which separates the resonators 16 and 18, are selected to enable inductive coupling to be provided between the resonators 16 and 18. This permits the filter 3 to provide a desired passband bandwidth and desired attenuation levels. The technique used for determining the dimensions and the materials of the filter components may be any suitable technique known in the art, such as, by example, those disclosed in the publications referenced above. As for the resonator 48 described above, the resonators 16 and 18 preferably operate in the $TE_{01\delta}$ mode and exhibit a similar magnetic field as the resonator 48.

FIGS. 3*a* and 3*b* also illustrate a screw 44 and nut 42 which are similar to those described above. An end portion of the screw 44 is securely engaged with the inductive coupling disk 1 in a similar manner as described above, although any other suitable mechanism for engaging these parts may be employed, and a post may be used in lieu of the screw 44. Similarly, the screw 44 is engaged with a hole (not shown) provided through a top wall of the housing 14 in a similar manner as described above. However, in this embodiment of the invention, the hole is preferably located in the top wall so that, while the screw 44 is disposed in the hole, the screw 44 and the inductive coupling disk 1 share a center axis y' that is located at a center of the cavity 20, and which is located midway between center axes y" and y'" of the resonators 16 and 18, respectively.

The inductor ring 10 of the inductive coupling disk 1 provides magnetic coupling between these resonators 16 and 18, which magnetic coupling is in addition to the magnetic coupling provided between the resonators 16 and 18 via inductive coupling. The amount of magnetic coupling provided by the inductor ring 10 is a function of a distance (d2) between a bottom surface of the inductor ring 10 and a top surface of a bottom wall 14*a* of housing 14. This distance (d2) can be varied by adjusting the screw 44. When the screw 44 is adjusted to cause the inductive coupling disk 1 to become closer to a horizontal plane that extends through an axis x (FIG. 5*b*), the level of coupling provided by the inductor ring 10 increases. When the screw 44 is adjusted to cause the inductive coupling disk 1 to become closer to the top wall of housing 14 and away from the plane that extends through axis x, the level of coupling provided by the inductor ring 10 decreases.

The manner in which the inductor ring 10 provides magnetic coupling between the resonators 16 and 18 may be understood in view of the following exemplary case. In this exemplary case, it is assumed that the filter 3 is designed so that the resonator 16 and 18 are spaced apart by a distance which enables slightly less inductive coupling to be provided between these resonators 16 and 18 than is required to enable the filter to exhibit a desired passband bandwidth. The ring 10 may be employed to add to this inductive coupling provided between the resonators 16 and 18, and enables the total amount of coupling provided between the resonators 16 and 18 to be adjusted so that the filter exhibits a desired return loss and passband bandwidth. The ring 10 may also be employed to add to the inductive coupling in cases in which, by example, imprecise filter construction and/or variations in the filter's manufacturing tolerances cause the level of inductive coupling provided between the resonators 16 and 18 to be less than a predetermined level.

Additional coupling is provided between the resonator 16 and 18 by adjusting the screw 44 to cause the inductor ring 10 of the inductive coupling disk 1 to interact with the magnetic field H1 of resonator 16. The magnetic field H1 induces a current in the inductor ring 10. As a result of this current, energy is then coupled to the resonator 18 via magnetic field H2 of resonator 18. The amount of magnetic coupling needed to be provided by the inductor ring 10 in order for the filter 3 to yield the desired passband bandwidth can be determined by adjusting the screw 44 to vary the distance (d2) until the desired characteristics are observed.

Figure 4A:
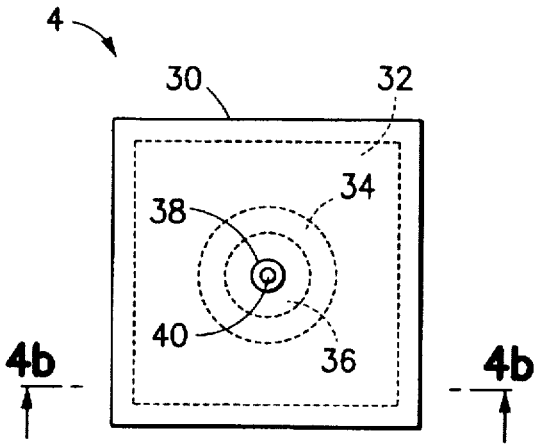
FIG. 4a PRIOR ART
FIG. 4*a* is a top view of a prior art filter that includes a metal tuning disk and a dielectric resonator.
Figure 4B:
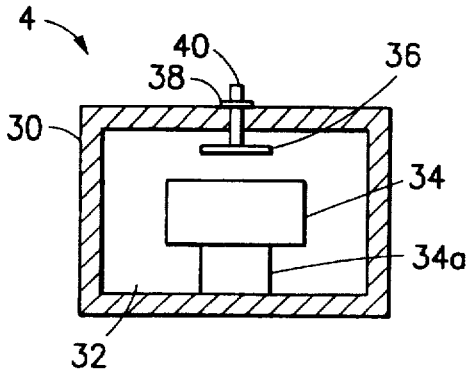
FIG. 4b PRIOR ART
FIG. 4*b* is a side view of a cross section of the filter of FIG. 4*a*, taken along the line 4*b*—4*b* of FIG. 4*a;*

As described above, because the inductor ring 10 is insulated from the screw 44, if any spurious responses are exhibited by the filter 3, they occur at frequencies that are much higher in the filter's upper stopband. Another advantage of the inductor ring 10 is that it is a low loss coupling device and is inexpensive to fabricate. Since the inductor ring 10 provides coupling between resonators, the inductor ring 10 has an advantage over the metal tuning disk 36 of FIGS. 4*a* and 5*b*, which cannot provide such coupling.

It should further be noted that the inductive coupling disk 1 may be employed to provide magnetic coupling between any adjacent resonators of a filter. Also, the inductive coupling disk 1 may be employed to provide magnetic coupling between two cross-coupled, non-adjacent resonators of a filter that is folded. Moreover, additional disks 1 may be employed in the filter 3 to provide tuning for the resonators 16 and 18.

Figure 6A:
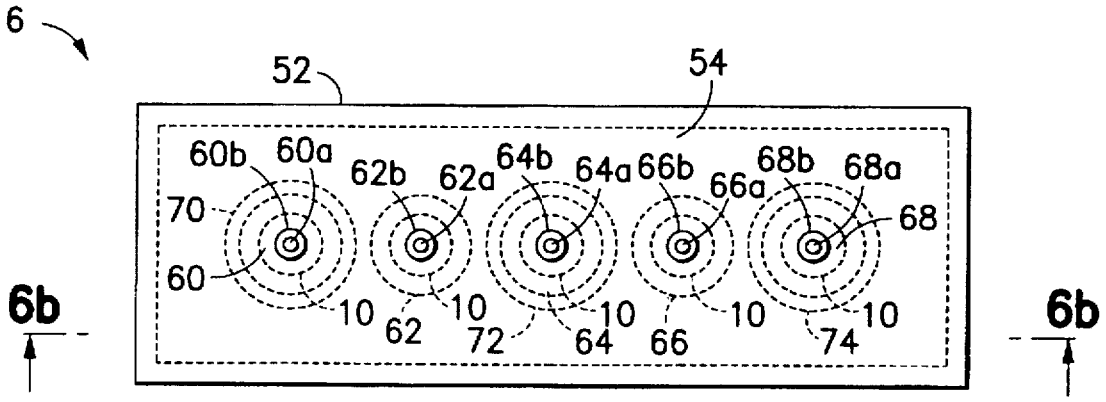
FIG. 6*a* is a top view of a filter that includes a plurality of inductive tuning and coupling disks constructed in accordance with the invention.
Figure 6B:
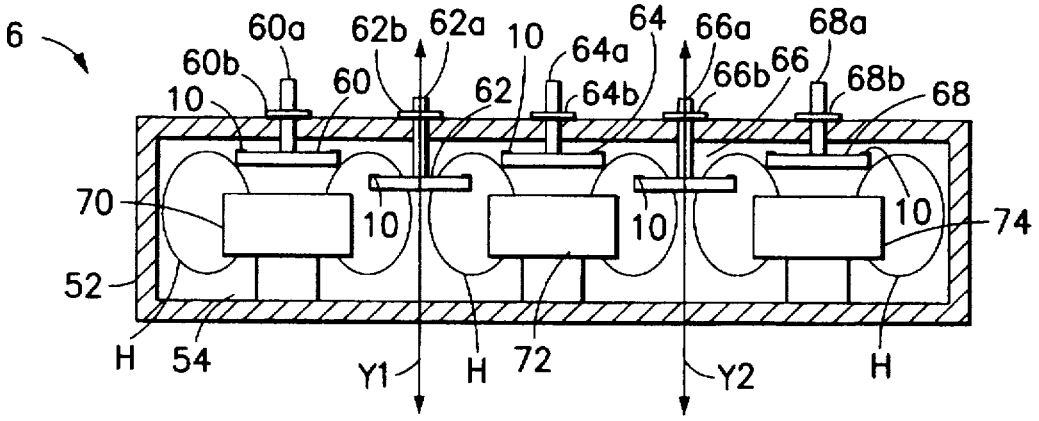
FIG. 6*b* is a cross section of the filter of FIG. 6*a*, taken along the line 6*b*—6*b* of FIG. 6*a;*

FIGS. 6*a* and 6*b* illustrate another embodiment of the invention, wherein a plurality of inductive tuning and coupling disks 60–68 are shown for providing tuning and coupling for a plurality of dielectric resonators 70–74 of a narrow passband bandwidth filter 6. Also shown in FIGS. 6*a* and 6*b* are screws 60*a*–68*a*, nuts 60*b*–68*b*, a cavity 54, and a housing 52 of the filter 6. These components are similar to the those described above, except that the housing 52 is sized large enough to house the resonators 70–74 and the disks 60–68, and to accommodate all of the screws 60*a*–68*a*. The disks 60, 64, and 68, the screws 60*a*, 64*a*, and 68*a*, and the nuts 60*b*, 64*b*, and 68*b* function in a similar manner as described above to enable the disks 60, 64 and 68 to provide tuning for the respective resonators 70, 72, and 74. The disks 62 and 66, the screws 62*a* and 66*a*, and the nuts 62*b* and 66*b* function in a similar manner as described above to enable magnetic coupling to be provided between the resonators 70 and 72 and between the resonators 72 and 74, respectively, via the inductive coupling disks 62 and 66, respectively. The disk 62 has a center axis Y1 that is preferably centered between the resonators 70 and 72. The disk 66 has a center axis Y2 that is preferably centered between the resonators 72 and 74. Magnetic fields (H) of the resonators 70–74 are also shown in FIG. 6*b*.

It should be noted that the inductive coupling disk and the screw assembly of the present invention may be employed in other types of DR filter structures, and may be positioned at another location within the filter which is suitable for providing a desired level of coupling.

Figure 8:
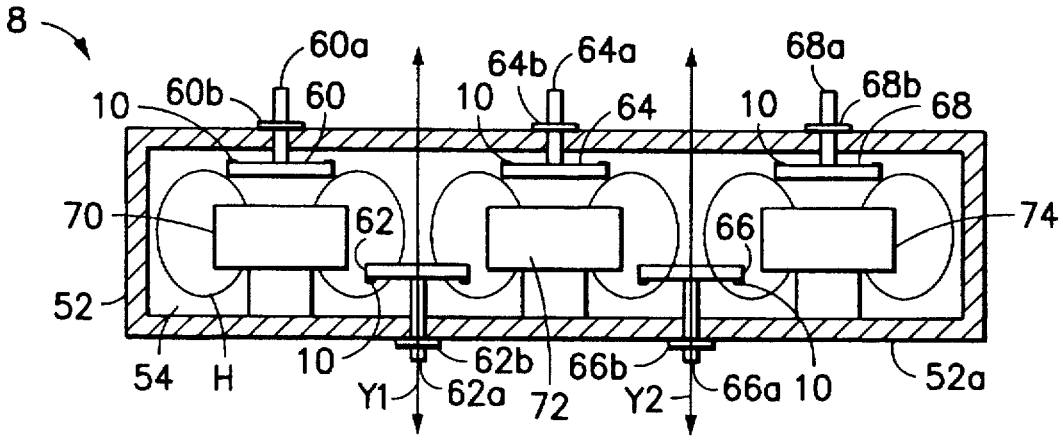
FIG. 8 illustrates a filter with a side wall cut away to show a plurality of inductive tuning and coupling disks, the filter being constructed in accordance with another embodiment of the invention.

By example, for a case in which the resonators of a filter must be spaced very closely together, it can be more convenient to place the inductive coupling disks at a bottom portion of the filter instead of at a top portion of the filter. A filter 8 having this configuration is shown in FIG. 8. The components of the filter 8 of FIG. 8 are similar to those of the filter 6 of FIGS. 6*a* and 6*b*, except that the assembly which includes the screw 62*a*, the nut 62*b*, and the inductive coupling ring 62, as well as the assembly which includes the screw 66*a*, the nut 66*b*, and the inductive coupling ring 66, are mounted to a bottom wall 52*a* of the housing 52.

While the invention has been particularly shown and described with respect to preferred embodiments thereof, it will be understood by those skilled in the art that changes in form and details may be made therein without departing from the scope and spirit of the invention.

What is claimed is:

1. An inductive tuning disk for tuning a resonator of a microwave filter to a resonant frequency, said microwave filter including a housing that encloses a cavity therein, said housing having a first wall and a second wall disposed opposite said first wall, said first wall of said housing having a support extending therefrom into said cavity, said resonator being secured to said second wall of said housing and exhibiting a magnetic field that appears in said cavity, said inductive tuning disk comprising:

a dielectric base, said dielectric base being positioned relative to said first wall by said support and being disposed within said cavity at an adjustable height above said resonator; and an inductor ring supported by a portion of said dielectric base, said inductor ring being spaced apart from a center of said base, said inductor ring comprising an electrically-conductive material, wherein said inductor ring interacts with said magnetic field resulting in a variation in a resonant frequency of said resonator as a function of said adjustable height above said resonator.

2. An inductive tuning disk as set forth in claim 1, wherein said dielectric base has a shape of a disk.

3. An inductive tuning disk as set forth in claim 1, wherein said inductor ring comprises a wire.

4. An inductive tuning disk as set forth in claim 1, wherein said inductor ring is comprised of a metallic film.

5. An inductive tuning disk as set forth in claim 1, wherein said inductor ring has a mean circumference that is less than one wavelength.

6. An inductive tuning disk as set forth in claim 1, wherein said dielectric base includes a circuit board.

7. An inductive tuning disk as set forth in claim 1, wherein said inductive tuning disk, said inductor ring, and said resonator have a common center axis.

8. An inductive tuning disk as set forth in claim 1, wherein said dielectric base includes a recess at a center thereof, said recess being securely engaged with an end of said support.

9. An inductive coupling disk for coupling a pair of resonators of a microwave filter, said microwave filter including a housing that encloses a cavity therein, said housing including a first wall and a second wall disposed opposite said first wall, said microwave filter further including a support that extends from one of said first and second walls and into said cavity along an axis that is between said pair of resonators, said pair of resonators exhibiting magnetic fields that appear in said cavity, said resonators being secured to said second wall of said housing and being spaced apart by a predetermined distance, said inductive coupling disk comprising:

a dielectric base, said dielectric base being supported from one of said first wall and said second wall of said housing by a support and being disposed within said cavity between a first one and a second one of said pair of resonators at an adjustable height above said second wall; and an inductor ring supported by a circumferential region of said dielectric base, said inductor ring including an electrically-conductive material, said inductor ring interacting with said magnetic fields and coupling said pair of resonators, wherein a level of coupling provided by said inductor ring is a function of said adjustable height above said second wall.

10. An inductive coupling disk as set forth in claim 9, wherein said dielectric base has a shape of a disk.

11. An inductive coupling disk as set forth in claim 9, wherein said inductor ring comprises a wire.

12. An inductive coupling disk as set forth in claim 9, wherein said inductor ring is comprised of a metallic film.

13. An inductive coupling disk as set forth in claim 9, wherein said inductor ring has a mean circumference that is less than one wavelength.

14. An inductive coupling disk as set forth in claim 9, wherein said dielectric base includes a circuit board.

15. An inductive coupling disk as set forth in claim 9, wherein said dielectric base includes a recess at a center thereof, said recess being in secured engagement with an end of said support.

16. A system of disks for use in a filter comprising a set of resonators, said resonators being spaced sufficiently apart to enable magnetic coupling to be provided between adjacent ones of said set of resonators, said system of disks comprising:

a first disk located above and spaced apart from a first one of said resonators for tuning said resonator;

a second disk located above and spaced apart from a second one of said resonators for tuning said second resonator; and a third disk having a center axis that is located between said first and second resonators, said third disk being spaced apart from said first and second resonators, said third disk for coupling said first and second resonators, wherein each of said first, second, and third disks comprises a dielectric base and a ring, wherein said ring comprises an electrically-conductive material and is supported by a circumferential region of said base.

17. A filter, comprising:

a housing enclosing a cavity therein, said housing having a first wall and a second wall disposed opposite said first wall;

a resonator secured to said second wall of said housing, said resonator exhibiting a magnetic field that appears within said cavity;

an inductive tuning disk; and means, being adjustable, for supporting said inductive tuning disk from said first wall at a height above said resonator, said height being adjustable by adjustment of said supporting means;

wherein said inductive tuning disk comprises a ring and a dielectric base, said ring being supported by circumferential region of said dielectric base, said ring comprising an electrically-conductive material for interacting with said magnetic field to vary a resonant frequency of said resonator as a function of said height.

18. A filter as set forth in claim 17, wherein said supporting means comprises a screw, said screw being in threaded engagement with said first wall.

19. A filter as set forth in claim 18, wherein said dielectric base includes a recess at a center thereof, said recess being in secured engagement with an end of said screw.

20. A filter as set forth in claim 17, wherein said ring comprises one of a wire and a metallic film.

21. A filter as set forth in claim 17, wherein said ring has a mean circumference that is less that one wavelength.

22. A filter, comprising:

a housing, said housing enclosing a cavity, said housing having a first wall and a second wall disposed opposite said first wall;

a pair of resonators secured to said second wall and being spaced sufficiently apart to enable magnetic coupling to be provided between said pair of resonators, said resonators exhibiting magnetic fields in said cavity;

an inductive coupling disk;

means for supporting said inductive coupling disk from one of said first wall and said second wall, said inductive coupling disk having a center axis that is between said pair of resonators, said supporting means being adjustable for adjusting a height of said inductive coupling disk above said second wall, wherein said inductive coupling disk comprises a dielectric base and an electrically-conductive ring, wherein said electrically-conductive ring interacts with said magnetic fields and couples said pair of resonators, and wherein a level of coupling provided by said electrically-conductive ring is a function of said height.

23. A filter as set forth in claim 22, wherein said supporting means comprises a screw that is in threaded engagement with said first wall.

24. A filter as set forth in claim 22, wherein said dielectric base includes a recess at a center thereof, said recess being in secured engagement with an end of said supporting means.

25. A filter as set forth in claim 22, wherein said ring comprises one of a wire and a metallic film.

26. a filter as set forth in claim 22, wherein said ring has a mean circumference that is less than one wavelength.

27. An inductive tuning disk as set forth in claim 1, wherein said resonator is a dielectric resonator.

28. An inductive coupling disk as in claim 9, wherein each of said pair of resonators is a dielectric resonator.

29. A system of disks for use in a filter as in 16, wherein each resonator of said set of resonators is a dielectric resonator.

30. A filter as in 17, wherein said resonator is a dielectric resonator.

31. A filter as in 22, wherein each of said pair of resonators is a dielectric resonator.

32. A filter, comprising:

a housing enclosing a cavity therein, said housing having a first wall and a second wall disposed opposite said first wall;

at least one dielectric resonator secured to said second wall of said housing, said at least one dielectric resonator exhibiting a magnetic field that appears within said cavity;

at least one inductive tuning disk; and means, being adjustable, for supporting said at least one inductive tuning disk from said first wall at a height above said at least one dielectric resonator, said height being adjustable by adjustment of said supporting means;

wherein said at least one inductive tuning disk comprises a ring and a dielectric base, said ring being supported by a circumferential region of said dielectric base and having a mean circumference that is less than one wavelength, said ring comprising an electrically-conductive material for interacting with said magnetic field to vary a resonant frequency of said at least one dielectric resonator as a function of said height.

33. A filter, comprising:

a housing, said housing enclosing a cavity, said housing having a first wall and a second wall disposed opposite said first wall;

at least one pair of dielectric resonators secured to said second wall and being spaced sufficiently apart to enable magnetic coupling to be provided between said at least one pair of dielectric resonators, each of said at least one pair of dielectric resonators exhibiting magnetic fields in said cavity;

at least one inductive coupling disk;

means for supporting said at least one inductive coupling disk from one of said first wall and said second wall, said at least one inductive coupling disk having a center axis that is between said at least one pair of dielectric resonators, said supporting means being adjustable for adjusting a height of said at least one inductive coupling disk above said second wall, wherein said at least one inductive coupling disk comprises a dielectric base and an electrically-conductive ring having a mean circumference that is less than one wavelength, wherein said electrically-conductive ring interacts with said magnetic fields and couples said at least one pair of dielectric resonators, and wherein a level of coupling provided by said electrically-conductive ring is a function of said height.

* * * * *